United States Patent [19]

Hansen

[11] Patent Number: 4,501,372

[45] Date of Patent: Feb. 26, 1985

[54] TEAR-OPEN CLOSURE FOR A CONTAINER

[76] Inventor: Gerhard Hansen, Heerstrasse 20, 7166 Sulzbach-Laufen 2, Fed. Rep. of Germany

[21] Appl. No.: 587,815

[22] Filed: Mar. 8, 1984

[30] Foreign Application Priority Data

Mar. 22, 1983 [DE] Fed. Rep. of Germany ..... 3310265

[51] Int. Cl.[3] ..... B65D 51/00

[52] U.S. Cl. ..... 215/247; 215/249; 215/253; 220/257; 220/269

[58] Field of Search ..... 215/247, 249, 250, 251, 215/253, 256, 258, 305, 341; 220/254, 257, 266, 269, 270

[56] References Cited

U.S. PATENT DOCUMENTS

| | | | |
|---|---|---|---|
| 2,340,419 | 2/1944 | Nawoj et al. | 215/253 |
| 3,071,274 | 1/1963 | Ravin | 215/249 |
| 3,379,326 | 4/1968 | Andersen | 215/249 |
| 3,509,879 | 5/1970 | Bathish et al. . | |
| 3,744,662 | 7/1973 | Zundel | 220/269 |
| 3,888,377 | 6/1975 | Stadler | 215/249 |
| 3,904,059 | 9/1975 | Bellamy, Jr. et al. | 215/247 |

FOREIGN PATENT DOCUMENTS 2501428 8/1975 Fed. Rep. of Germany .

*Primary Examiner*—Steven M. Pollard

*Attorney, Agent, or Firm*—Roylance, Abrams, Berdo & Goodman

[57] ABSTRACT

A tear-open closure for a container comprises a thermoplastic cap having score lines on its top wall defining separated top parts, and a gasket. The gasket has at least two puncture points with at least one puncture point covered by each top part. The closure can be opened such that only one puncture point is exposed by removal of one top part, while the other puncture point remains covered by the other top part. The cap top wall rests on the gasket between the two score lines.

15 Claims, 7 Drawing Figures

TEAR-OPEN CLOSURE FOR A CONTAINER

FIELD OF THE INVENTION

The present invention relates to a container closure which can be easily opened by manually tearing and removing a part of the closure.

BACKGROUND OF THE INVENTION

A conventional tear-open closure has a closure part fastened to the neck of a container and has a base supporting two tubular extraction nozzles. Each extraction nozzle contains a separate gasket with a puncture point which can be perforated by a needle. The top of each extraction nozzle is covered by a removable piece of foil. Such closure is disclosed in DE-OS No. 25 01 428.

Another conventional tear-open closure has a closure part fastened to one end of a blood pouch or bag which has a convex shape. Two tubular extraction nozzles are mounted on this closure part, with each nozzle covered by a separate cap with a scored portion. Each removable cap part has an actuation member extending from it. Such closure is disclosed in U.S. Pat. No. 3,509,879 to Bathish et al.

Conventional tear-open closures of this type are disadvantageous in that they are relatively complex and expensive to manufacture. Additionally, the conventional tear-open closures tend to be relatively large and require significant amounts of material.

SUMMARY OF THE INVENTION

An object of the present invention is to provide a tear-open closure which is simple and inexpensive to manufacture.

Another object of the present invention is to provide a tear-open closure which does not take up much space or use a significant amount of material.

The foregoing objects are obtained by a tear-open closure for a container, comprising a cap of thermoplastic material and a gasket. The cap has a top wall and a depending side wall. First and second mutually exclusive top parts are defined in the top wall by scored parts of reduced top wall thickness. The scored parts are formed by grooves defining curves. A grip is coupled to each top part. The gasket extends within and against the side wall and against the top wall lower surface such that the gasket completely underlies all of both of the top parts and keeps the container closed upon removal of the top parts. At least one puncture point is formed in the gasket under each top part.

The use of a gasket, arranged beneath two tear-open top parts and extending over the area covered by the top wall of the closure, provides a tear-open closure which is simple and inexpensive to manufacture and which saves space and material. The closure can be separately mounted on a container or formed as an integral part of the container.

The number of top parts defined by the scored parts can correspond to the number and/or the size of the associated puncture points in the gasket. The separation between the two top parts facilitates recognition of the puncture point to be perforated.

Preferably, the top parts are spaced at different distances from the central vertical axis of the top wall and side wall, and of the container.

An infusion container generally has three puncture points. One puncture point is for introducing a substance into the container at the central laboratory. The other two puncture points are for extracting the contents of the container at bedside. For this use, the first top part can cover two puncture points, while the second top part covers a single puncture point.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS

Figure 1:
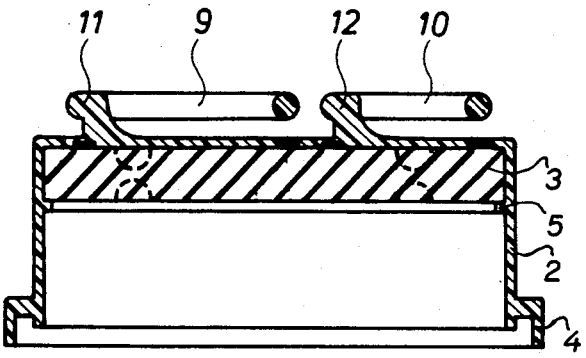
FIG. 1 is a side elevational view in section of a tear-open closure, taken along line I—I of FIG. 3, according to a first embodiment of the present invention.
Figure 2:
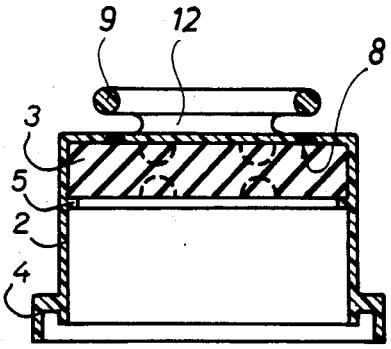
FIG. 2 is a side elevational view in section of the tear-open closure of FIG. 1, taken along line II—II of FIG. 3.

Referring initially to the embodiment of FIGS. 1–5, cap 1 is formed of thermoplastic material and can be welded in a suitable manner onto a thermoplastic container.

Cap 1 has a pot-shaped cap part 2 which can be fit and heat-sealed onto a neck of a container. A gasket 3 is set in cap part 2. Cap part 2 has a depending heat-seal edge 4 and an inwardly projecting collar 5 at some distance above edge 4 for fastening disk-shaped gasket 3 within cap part 2.

Figure 3:
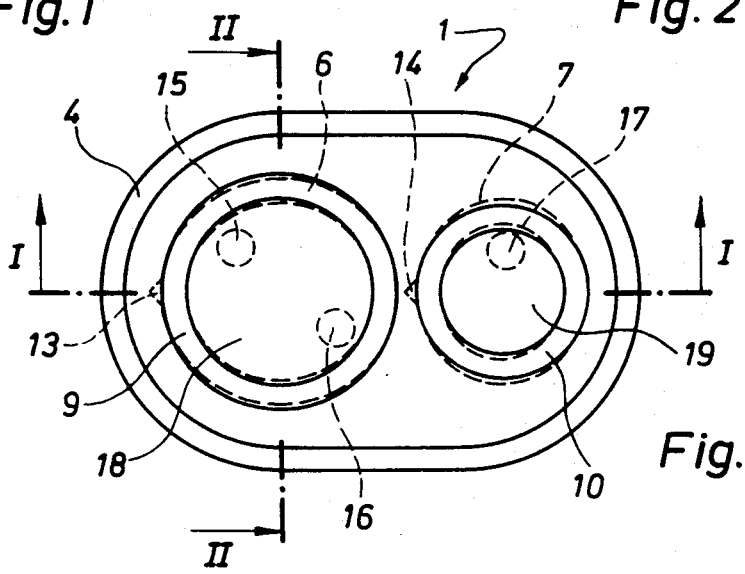
FIG. 3 is a top plan view of the tear-open closure of FIG. 1.
Figure 4:
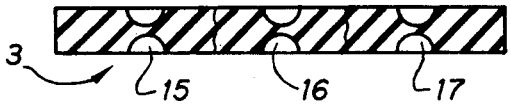
FIG. 4 is a side elevational view in section of the gasket of the closure of FIG. 1, taken along line IV—IV of FIG. 5.
Figure 5:
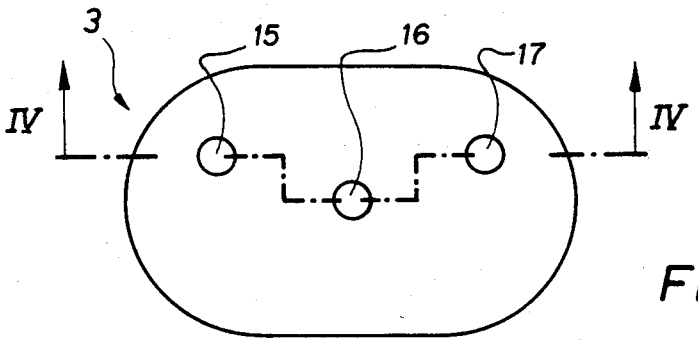
FIG. 5 is a top plan view of the gasket of FIG. 4.

Two score lines or scored parts 6 and 7 are provided on the flat top wall of cap part 2, as illustrated in FIG. 3 by two broken lines each. The two broken lines represent trapezoidal or wedge-shaped grooves 8 on the inside or inner surface of cap part 2. Each groove forms a closed ring and has a transverse cross section increasing in a direction toward gasket 3. An annular tear ring or grip 9 or 10 is coupled to each of the top parts 18 and 19 surrounded and defined by score lines 6 and 7.

Grips 9 and 10 are positioned above cap part 2 and parallel to its top wall. As illustrated in FIG. 1, the grips are fastened on their left sides to cap part 2 by connection pieces 11 and 12. A notch 13, which is triangular in top plan view and opens on score line 6, is provided on the inner surface of the top wall at the juncture between connection piece 11 and the top wall of cap part 2. A corresponding notch 14 opens on score line 7 and is associated with connection piece 12. Notches 13 and 14 facilitate opening of the closure by removing top parts 18 and 19 along scored parts 6 and 7 by assisting separation at the points where the scored parts are connected with connection pieces 11 and 12, respectively, on the top wall of cap part 2.

Gasket 3 is oval and disk-shaped in plan view, and can be formed of rubber, particularly silicon rubber. Three puncture points 15, 16 and 17 are formed in gasket 3 by opposed pairs of substantially hemispherical depressions in both sides of the gasket. Puncture points 15 and 16 are covered by top part 18, while puncture point 17 is covered by top part 19. Cap 1 engages gasket 3 between puncture points 16 and 17. Puncture point 17 can be used for introducing an additional substance (for example, a vitamin) into the container at the central laboratory of a hospital. Puncture points 15 and 16 are for bedside extraction of the contents in the container.

When a substance must be added to the container, tear ring 10 is pulled to separate and remove top part 19 along scored part 7. When scored part 7 is opened, scored part 6 remains closed. Top part 18 is not removed until the matter in the container is to be discharged with the aid of an infusion device. The infusion device can penetrate puncture points 15 and 16 for delivery of the matter in the container to a patient.

Figure 6:
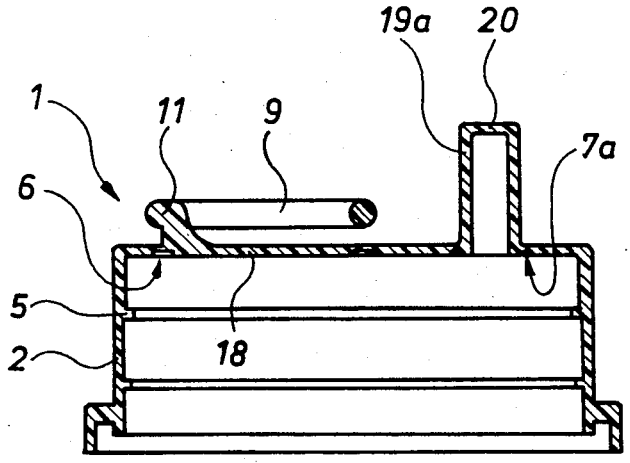
FIG. 6 is a side elevational view in section of a tear-open closure according to a second embodiment of the present invention.

The second embodiment, illustrated in FIG. 6, closely corresponds to the first embodiment of FIGS. 1–5. The same parts are indicated with the same numbers, while changes are indicated by the addition of the letter a. The closure of the second embodiment can also be welded onto a thermoplastic container.

Adjacent first top part 18 (configured as in the first embodiment), second top part **19*a* is configured as an inverted cap with its bottom wall 20 at the top. Score line 7*a*, at the free edge of top part 19*a*, extends in the same plane as score line 6. Top part 19*a* is located over puncture point 17**.

Figure 7:
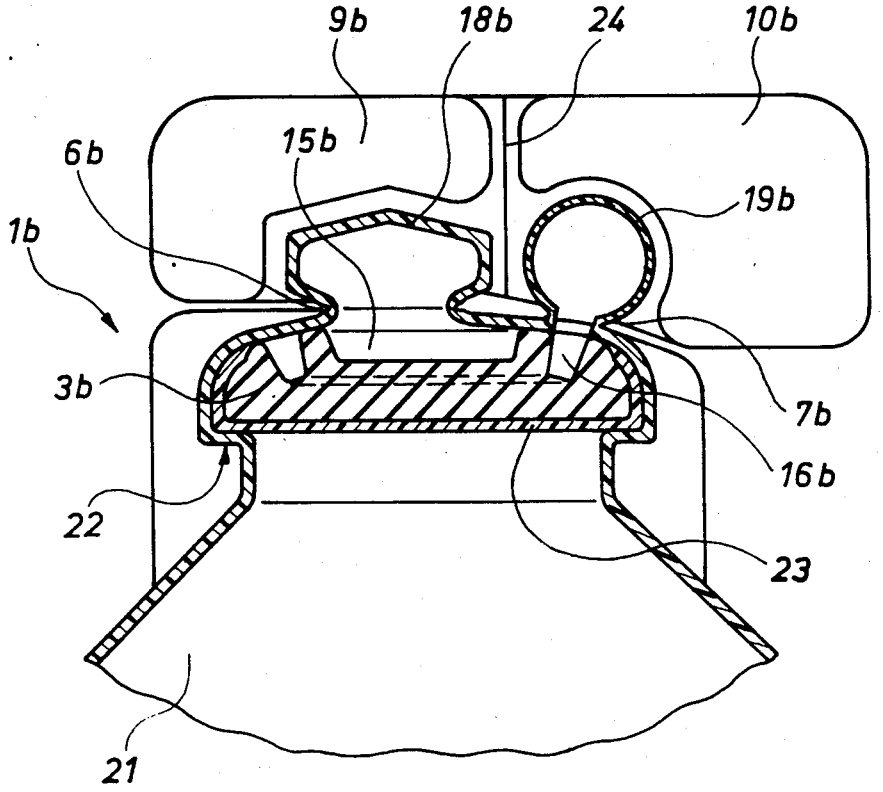
FIG. 7 is a side elevational view in section of a tear-open closure according to a third embodiment of the present invention.

In the third embodiment, illustrated in FIG. 7, the parts identical with those of the first embodiment are indicated with the same numbers. The parts which differ are indicated by the addition of the letter b. The circular cap **1*b*, shown in transverse cross section, is unitarily formed in one-piece with a cylindrical container 21, only the neck of which is shown. A beaded gasket 3*b* is fixed in cap 1*b* and rests on a flange 22 projecting into container 21. The gasket is surrounded on its bottom and outer periphery by an insert 23, which insert can be heat-sealed to cap 1*b*, at least at its edge. Gasket 3*b* has a cup-shaped recess 15*b* in the middle of its top surface forming a large puncture point. An annular groove 16*b* surrounds recess 15*b* forming a small puncture point. Recess 15*b* is covered by a bonnet-shaped top part 18*b* arranged eccentrically relative to the vertical central axis of cap 1*b* and recess 15*b*. Score line 6*b* is provided on the inwardly drawn bottom section of top part 18*a*. On the right side of FIG. 7, adjacent top part 18, a top part 19*b* is formed on the cap in the general shape of a hollow ball. Top part 19*b* has a circular opening directly over annular groove 16*b*. Circular score line 7*b* is formed where the top wall of cap 1*b* engages top part 19*b***.

Top parts **18*b* and 19*b* have unitarily formed grips 9*b* and 10*b*, respectively. These grips extend in one plane and are separated from each other by a score line or split 24. Grip parts 9*b* and 10*b* are also separate from cap 1*b***.

The part of cap **1*b* between top parts 18*b* and 19*b* directly engages gasket 3*b*. When top part 19*b* is removed, only annular groove 16*b*, which serves as a puncture point, is exposed and accessible. Central recess 15*b* remains covered by top part 18*b* and by the part of the top wall of cap 1*b* engaging the gasket adjacent the edge of recess 15*b*. Recess 15*b* is not accessible until top part 18*b* is removed from cap 1*b*. Since the removal of one of the top parts 18*b* or 19*b* from cap 1*b* does not impair the other part 19*b* or 18*b*, it is also possible to remove top part 18*b* before top part 19*b***.

Score lines 6 and 7 must be spaced at least 2 mm from each other. A 3 mm spacing is preferred to ensure that cap 1 adequately covers the gasket under it. This spacing also avoids contaminating puncture points 15 and 16 covered by top part 18, when puncture point 17 is exposed by removal of top part 19, or vice versa.

While various embodiments have been chosen to illustrate the invention, it will be understood by those skilled in the art that various changes and modifications can be made therein without departing from the scope of the invention as defined in the appended claims.

What is claimed is:

1. A tear-open closure for a container, comprising:

a cap of thermoplastic material having a top wall with upper and lower surfaces and a side wall depending from said top wall;

first and second mutually exclusive top parts defined in said top wall by scored parts of reduced thickness, said scored parts formed by grooves arranged as curves;

first and second grips coupled to said first and second top parts, respectively; and a gasket extending within and against said side wall and against said lower surface of said top wall such that said gasket completely underlies all of said top parts and keeps the container closed upon removal of said top parts, said gasket having at least first and second puncture points within said first and second top parts, respectively.

2. A tear-open closure according to claim 1 wherein said first top part is larger than said second top part.

3. A tear-open closure according to claim 2 wherein said top wall and said side wall have a common central vertical axis, said first and second top parts being spaced at different distances from said axis.

4. A tear-open closure according to claim 3 wherein said first top part covers more puncture points in said gasket than said second top part.

5. A tear-open closure according to claim 3 wherein said second puncture point is an annular groove in said gasket surrounding said first puncture point.

6. A tear-open closure according to claim 2 wherein said first top part covers more puncture points in said gasket than said second top part.

7. A tear-open closure according to claim 2 wherein said second puncture point is an annular groove in said gasket surrounding said first puncture point.

8. A tear-open closure according to claim 1 wherein said top wall and said side wall have a common central vertical axis, said first and second top parts being spaced at different distances from said axis.

9. A tear-open closure according to claim 1 wherein said first top part covers more puncture points in said gasket than said second top part.

10. A tear-open closure according to claim 1 wherein said second puncture point is an annular groove in said gasket surrounding said first puncture point.

11. A tear-open closure according to claim 1 wherein said first and second grips have different configurations.

12. A tear-open closure according to claim 11 wherein said top wall and said side wall have a common central, vertical axis, said first and second grips being unitarily formed as one piece and separated by a weakened separation line spaced from said axis.

13. A tear-open closure according to claim 1 wherein said top wall and said side wall have a common central, vertical axis, said first and second grips being unitarily formed as one piece and separated by a weakened separation line spaced from said axis.

14. A tear-open closure according to claim 1 wherein each of said puncture points comprises an area of reduced thickness in said gasket.

15. A tear-open closure according to claim 1 wherein said gasket is unitarily formed as a single, one-piece member.

* * * * *